United States Patent [19]

Blaha

[11] Patent Number: 4,691,079

[45] Date of Patent: Sep. 1, 1987

[54] SCREW-ON WIRE CONNECTOR

[75] Inventor: William E. Blaha, Elgin, Ill.

[73] Assignee: Ideal Industries, Inc., Sycamore, Ill.

[21] Appl. No.: 935,619

[22] Filed: Dec. 3, 1986

Related U.S. Application Data

[63] Continuation-in-part of Ser. No. 760,275, Jul. 29, 1985, abandoned.

[51] Int. Cl.[4] ..... H01R 4/22

[52] U.S. Cl. ..... 174/87

[58] Field of Search ..... 174/87; 403/214, 396

[56] References Cited

U.S. PATENT DOCUMENTS

| | | | |
|---|---|---|---|
| 3,156,761 | 11/1964 | Schinske | 174/87 |
| 3,297,816 | 1/1967 | Waddington | 174/87 |
| 3,440,333 | 4/1969 | Blomstrand | 403/396 X |
| 3,497,607 | 2/1970 | Swanson | 174/87 |
| 3,676,574 | 7/1972 | Johansson et al. | 174/87 |
| 3,902,005 | 8/1975 | Norden | 174/87 |
| 4,150,251 | 4/1979 | Scott | 174/87 |
| 4,227,040 | 10/1980 | Scott | 174/87 |
| 4,473,715 | 9/1984 | Beinhaur et al. | 174/87 |

*Primary Examiner*—Morris H. Nimmo

*Attorney, Agent, or Firm*—Kinzer, Plyer, Dorn, McEachran & Jambor

[57] ABSTRACT

A screw-on electrical connector for connecting the stripped ends of electrical wires has a shell made of stiffly flexible plastic material. A generally central bore extends from an open end of the shell to a closed end which is closed by an integral end wall. A generally tapered wire coil lies in the bore and engages an outer area on the inner surface of the bore, adjacent its open end. A radial undercut is formed on the inner surface of the bore near the end wall. The undercut projects into the bore to support the coil and to strengthen the shell.

11 Claims, 13 Drawing Figures

Fig. 4.
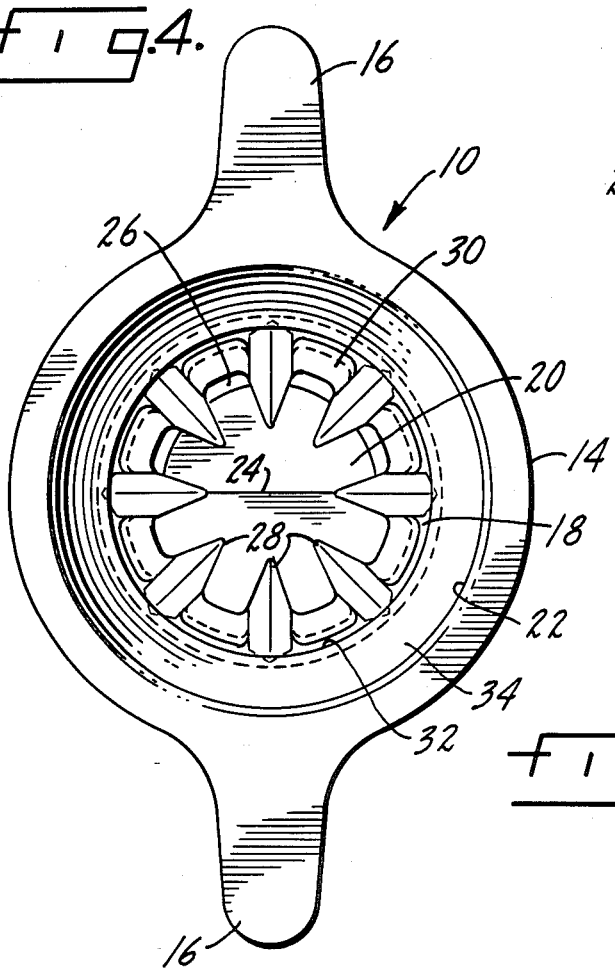
Fig. 6.
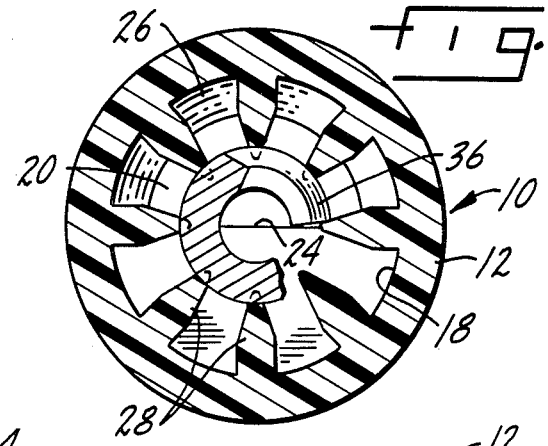
Fig. 7.
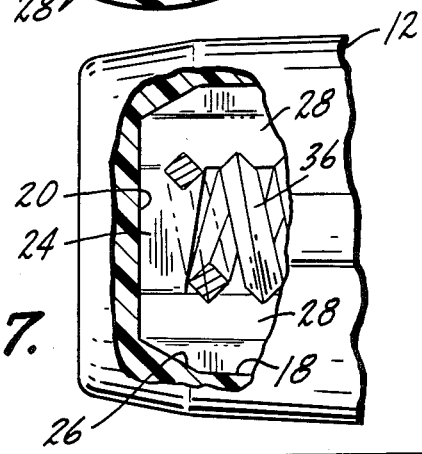
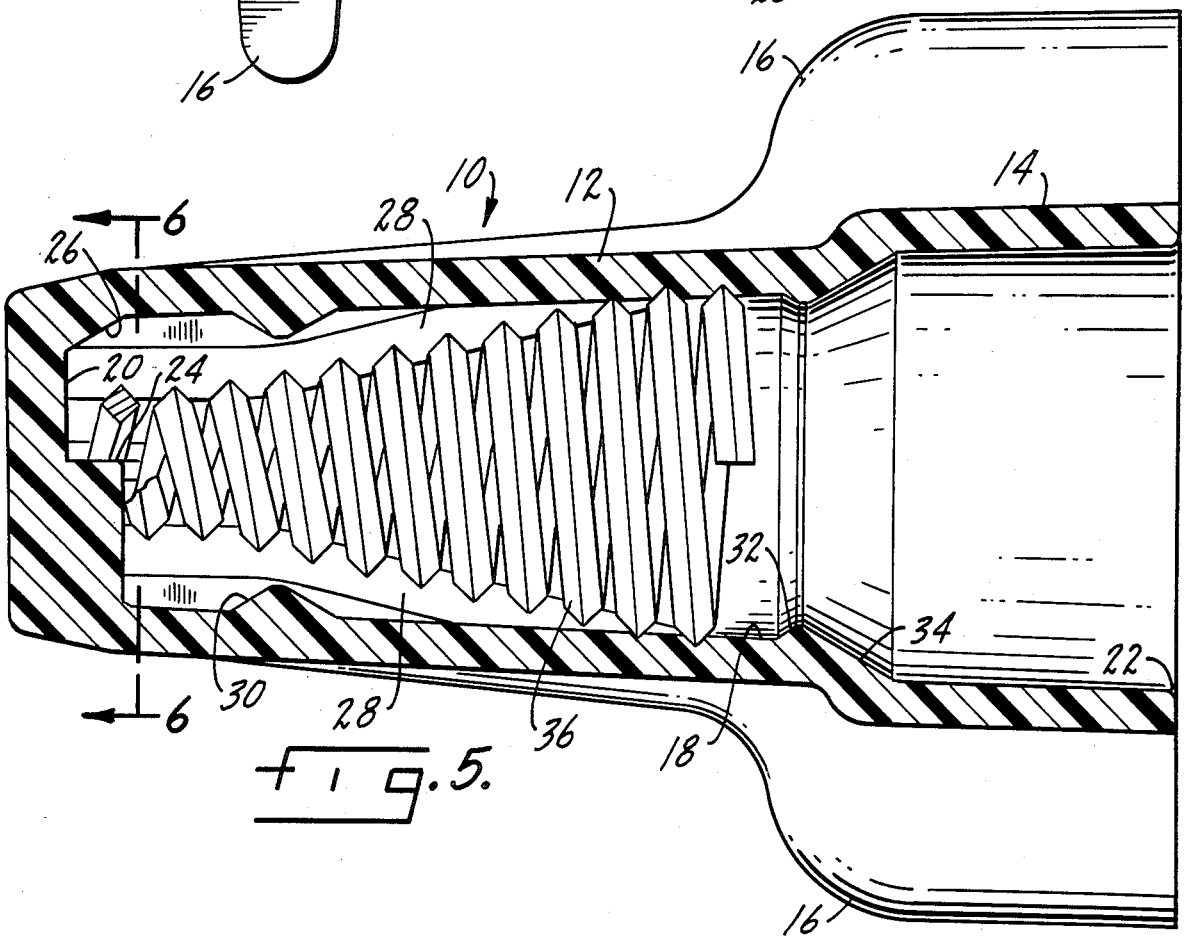
Fig. 5.

SCREW-ON WIRE CONNECTOR

This is a continuation-in-part of co-pending application Ser. No. 760,275 filed on July 29, 1985, now abandoned.

SUMMARY OF THE INVENTION

This invention relates to screw-on wire connectors of the type having a shell of insulating material with a wire coil or spring disposed inside the shell. One of the objects of the present invention is a wire connector of the type described having an improved shell interior configuration which is easier to manufacture, uses less plastic material and less wire coil material and lowers tooling costs over prior wire connectors.

Another object of the invention is a wire connector which can accommodate an increased number of wire combinations over prior connectors.

Another object is a wire connector of the type described which can be made with lower cost tooling because there are no threads in the interior of the shell.

A further object of the invention is a wire connector which is easier to get off of the core pin used in the molding process.

Another object of the invention is a wire connector having a shell which speeds up molding because it reduces cycle time.

Another object of the invention is a wire connector which allows the overall size of the mold for the shell to be reduced because the spacing distance between the core pins can be less.

Still another object of the invention is a wire connector having a shell which will not become stuck in the mold cavity in the event of a molding short shot.

These and other objects are achieved by an electrical connector having a cap or shell of insulating material having a central bore open at one end of the cap and closed at the other end by an integral end wall. A tapered wire coil or spring is disposed in the shell with an outer portion of the coil engaging the inner surface of the bore near its open end. A radial undercut is formed on the inside of the shell near the end wall. This undercut is designed as a flattened triangle and extends into the bore to support the coil or spring entering the bottom stop area of the shell and to support the shell and limit radial expansion of the shell. The undercut engages the spring when the spring is expanded by wires inserted into the connector. Also, the undercut grips the core pin so the connector can be pulled out of the mold cavity. The location of the undercut near the end wall of the shell insures that the shell can be pulled out of a mold cavity even after a molding short shot.

BRIEF DESCRIPTION OF THE DRAWINGS

FIG. 4 is an end view of a shell, looking into the open end of the shell.

FIG. 5 is a longitudinal section of a complete connector.

FIG. 6 is a section along line 6—6 of FIG. 5.

FIG. 7 is a detail view, with portions cut away, of the closed end of a connector.

DETAILED DESCRIPTION OF THE INVENTION

FIGS. 1–4 illustrate one embodiment of a wire connector shell or cap according to the present invention. The shell 10 includes a generally conical housing 12 with a skirt 14 of slightly larger diameter. A pair of projecting wings or extensions 16 may optionally be attached to the outer surface of the housing to provide additional leverage when the connector is screwed onto a pair of wires. The shell is made of stiffly flexible plastic material.

Figure 1:
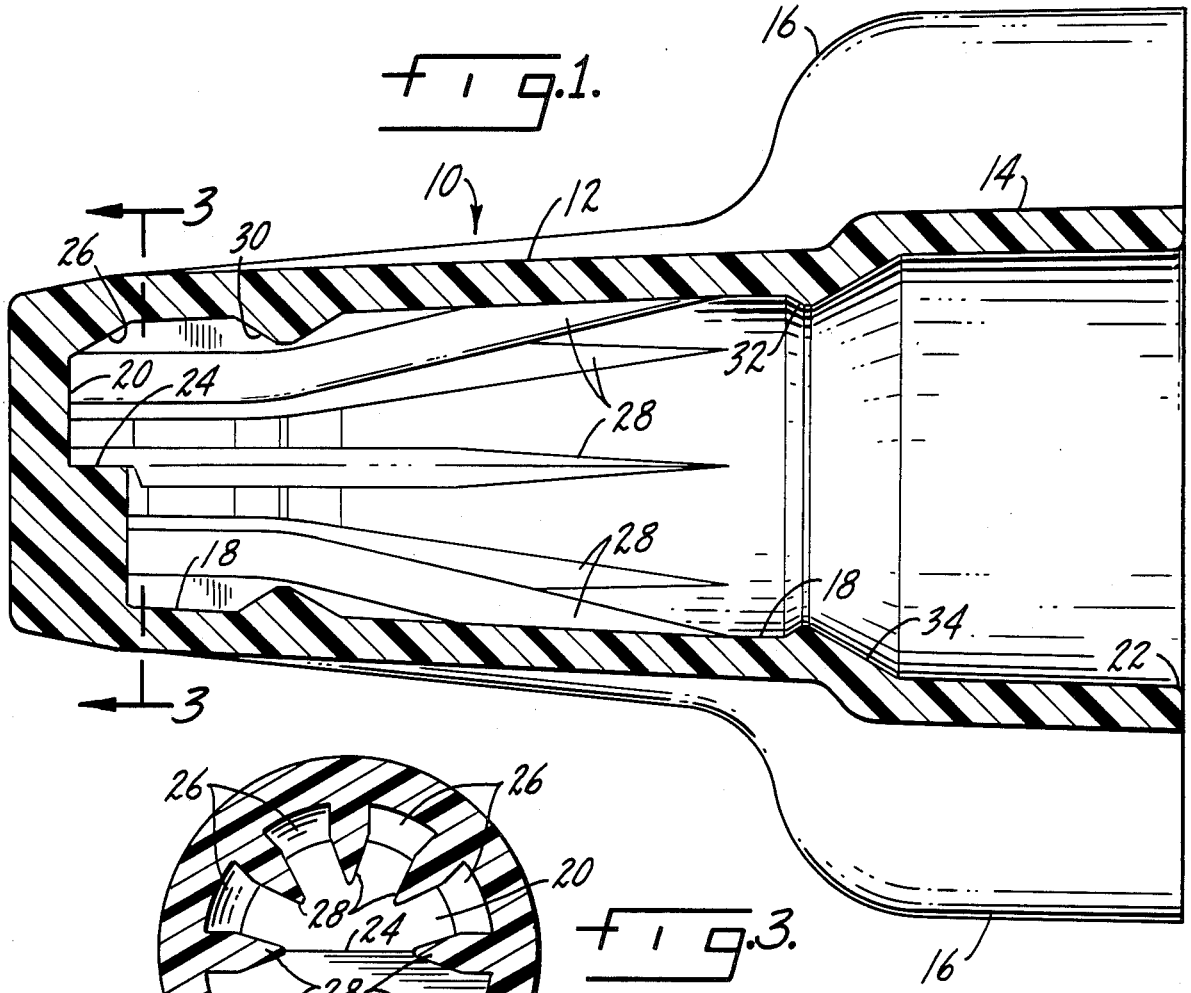
FIG. 1 is an enlarged, longitudinal section through a connector shell, according to the present invention.
Figure 3:
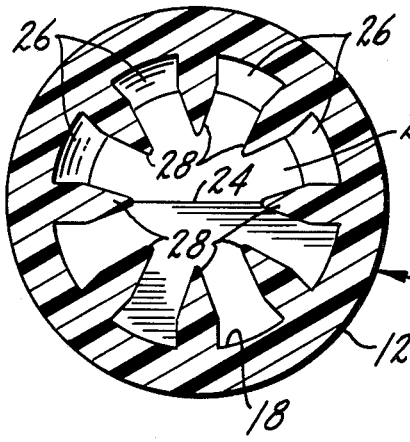
FIG. 3 is a section taken along line 3—3 of FIG. 1.
Figure 2:
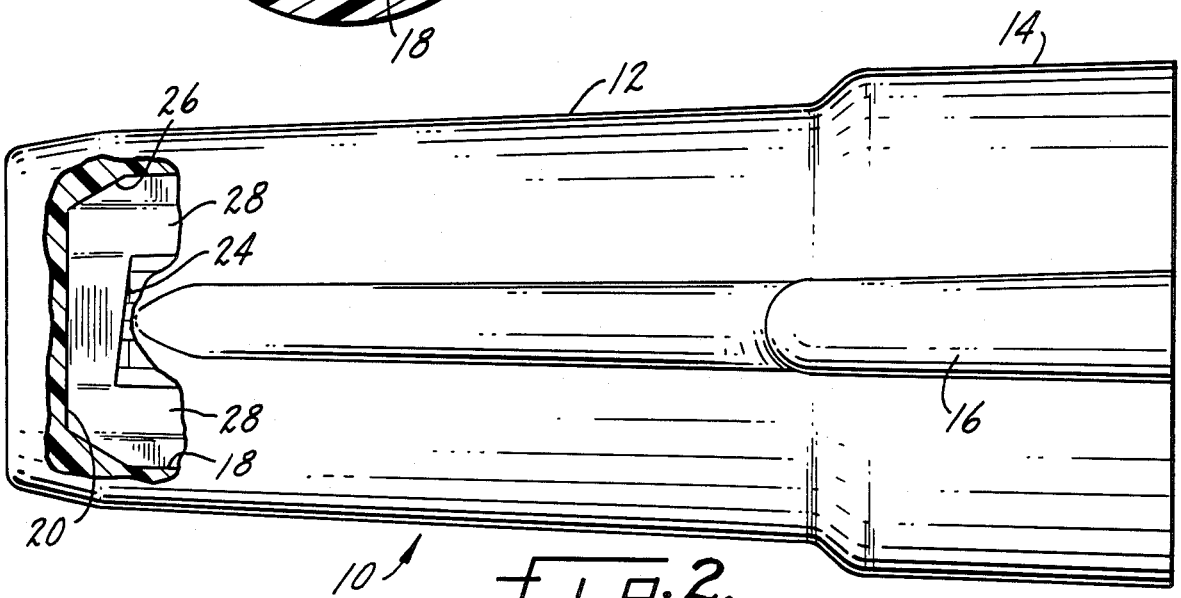
FIG. 2 is a plan view of the shell with portions cut away.

The shell has a generally central bore 18 extending from an integral end wall 20 to an open end 22 at the end of the skirt 14. The end wall 20 includes an end stop 24 which projects into the bore; the end stop 24 covers about half of the inner surface of the end wall. The stop has a ramp-like configuration of varying thickness, as best seen in FIG. 2. On the half of the end wall not occupied by the end stop, the end wall is joined to the housing 12 by angled surfaces 26.

A plurality of splines or ridges 28 are formed on the interior surface of the bore 18. Each spline has an outer, conical portion and an inner straight portion adjacent the end wall. The splines have an elongated, triangular cross section.

A first, radial undercut 30 is formed on the inner surface of the bore at approxiamtely the transition point of the splines from conical to straight. Thus, the undercut is located closer to the end wall 20 than to the opening 22. The undercut has a flattened, triangular configuration. A second, outer undercut 32 is located at the transition of the housing 12 from the inner, conical portion to the outer skirt portion. The undercut 32 has a somewhat elongated angled surface 34 joining the skirt 14 to the undercut.

FIGS. 5–7 show the completed connector with the shell 10 and the tapered wire coil or spring 36. As seen in FIG. 5, the outermost turn of the coil 36 engages the inner surface of the bore 18 at a point adjacent the undercut 32. This engagement between the coil and bore surface holds the coil in the shell. The coil is screwed into the shell until the innermost end of the coil hits the end stop 24. This is best seen in FIGS. 6 and 7. The splines 28 contact the spring or coil 36 over its entire length for support. The splines are curved to lead the coil into an ever tightening bottom and to the end stop 24. The splines provide equal and opposite measured pressure to a multitude of wire combinations. They also act as a spring stop during reverse rotation. The splines provide radial and columnar strength to the shell wall.

The outer undercut 32 helps funnel multiple wires and strands into the coil 36. It also increases the strength of the shell and prevents the springs from being pulled out. The outer undercut is also useful in the molding process of the shell in that it serves to prevent the shell from becoming stuck in the mold cavity during molding and it allows the shell to be removed from the core pin.

The first undercut 30 supports the shell and limits radial expansion of the shell when wires are inserted into the connector. It also provides measured strength to the splines and supports the coil 36 entering the bottom stop area. A particularly useful feature of the first undercut is that it prevents the shell from becoming stuck in the mold cavity during a molding short shot. In that event, the first undercut holds the defective shell on the core pin, allowing withdrawal of the shell from the mold cavity. By the same token, the undercuts 30 and 32 allow the shell to be easily removed from the core pin when it is desired to do so.

Figure 8:
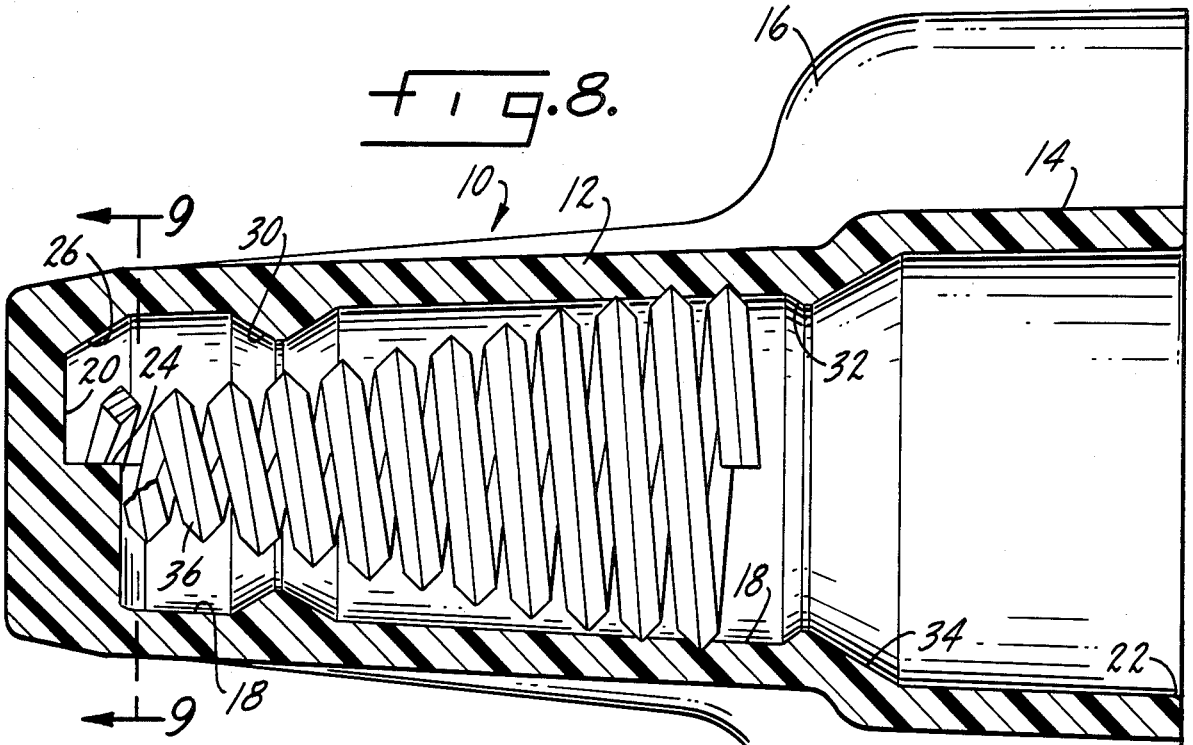
FIG. 8 is a longitudinal section of an alternate embodiment of connector.
Figure 9:
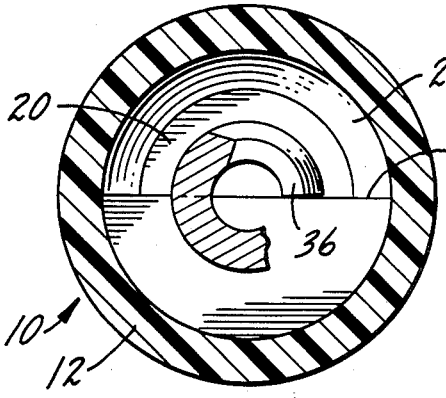
FIG. 9 is a section taken along line 9—9 of FIG. 8.
Figure 10:
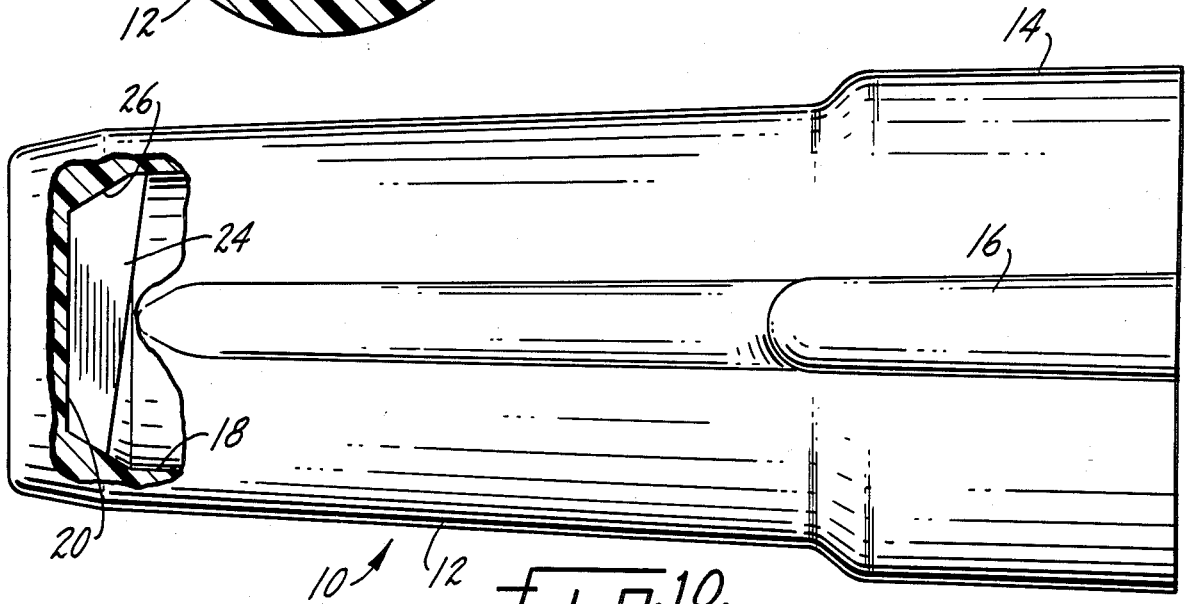
FIG. 10 is plan view of the connector of FIG. 8, with portions cut away.

FIGS. 8–10 show an alternate embodiment of the connector. This version is similar to that of FIGS. 1–7. Corresponding parts have been given the same reference numerals and their description will not be repeated. In this connector the splines 28 have been removed so the coil 36 is retained by the engagement of its outer coils with the inner bore surface adjacent the outer undercut 32. Further spring retention is provided when wires are inserted into the connector. The wires expand the coil 36 to the point that the inner turns of the coil engage the first undercut 30. Alternately, the taper of the bore 18 could be changed or the shape of the coil 36 could be changed so that the interference between the spring and the bore surface would be over the entire length of the spring.

Figure 11:
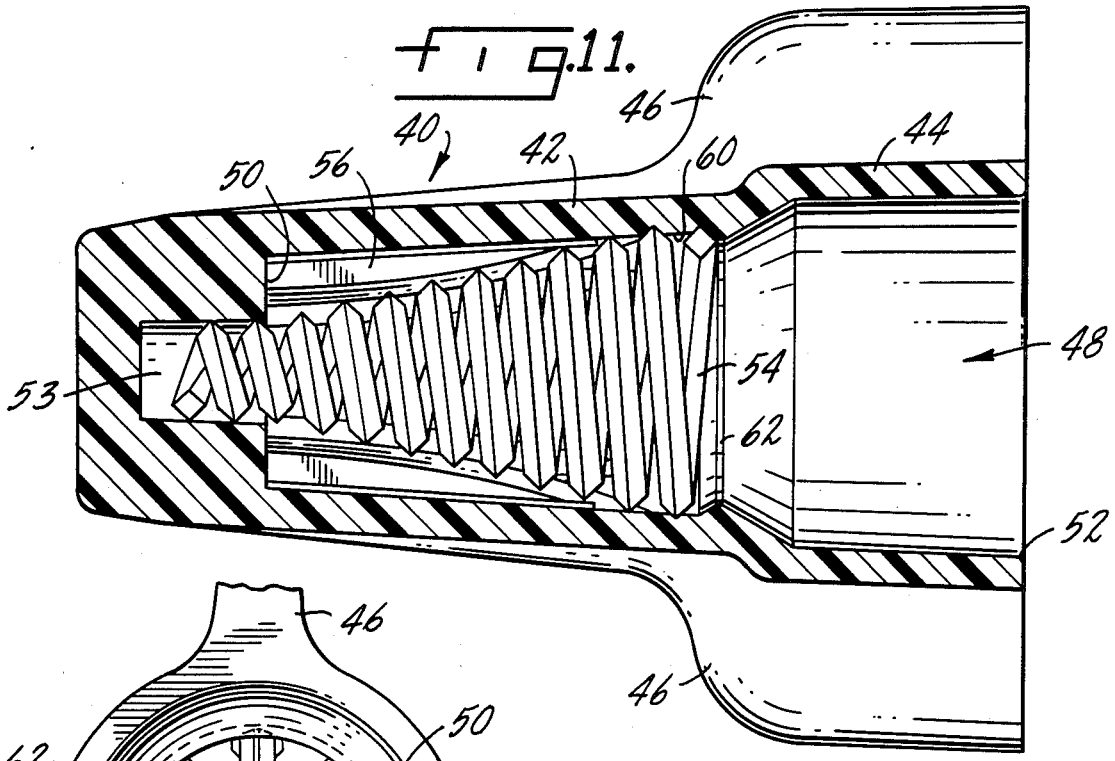
FIG. 11 is a longitudinal section of an alternate embodiment.
Figure 12:
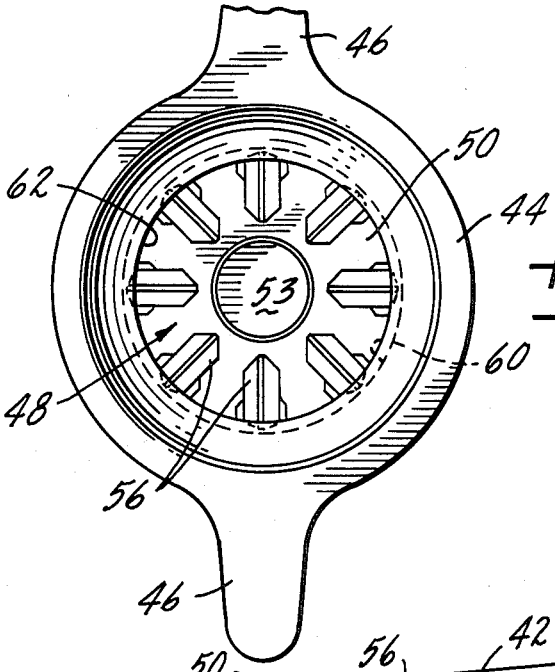
FIG. 12 is an end view of the shell of FIG. 11, looking into the open end.

FIGS. 11–12 show another alternate embodiment of the connector. This embodiment has a shell or cap 40 which includes a generally conical housing 42 with a skirt 44 of slightly larger diameter. A pair of projecting wings or extensions 46 may optionally be attached to the outer surface of the skirt and housing as in the previously described embodiments. The shell has a central bore 48 extending from an integral end wall 50 to an open end 52 at the end of the skirt 44. The end wall 50 includes a socket 53 which receives the inner end of the wire coil or spring 54. The coil 54 is preferably screwed into the cap 40. The diameter of the inner turns of the coil 54 is slightly greater than the diameter of the socket 53 so the coil embeds itself slightly into the surfaces of the socket.

A plurality of splines 56 extend from the end wall 50 toward the open end 52 of the cap. The splines have an arcuate shape, with a radius and center such that the splines stop short of the open end of the cap. This leaves an outer area of the bore with a smooth surface 60. In the embodiment of FIG. 11, the splines actually stop short of the skirt 44. Thus, the smooth surface 60 is on the interior of the housing portion 42. The outer turns of the wire coil 54 have a diameter greater than the inside diameter of the bore at the outer area 60. Thus, the outer turns of the coils embed into the outer area to assist in retaining the coil in the cap.

A radial undercut 62, similar to the second undercut 32, is located at the junction between the housing 42 and the skirt 44.

Figure 13:
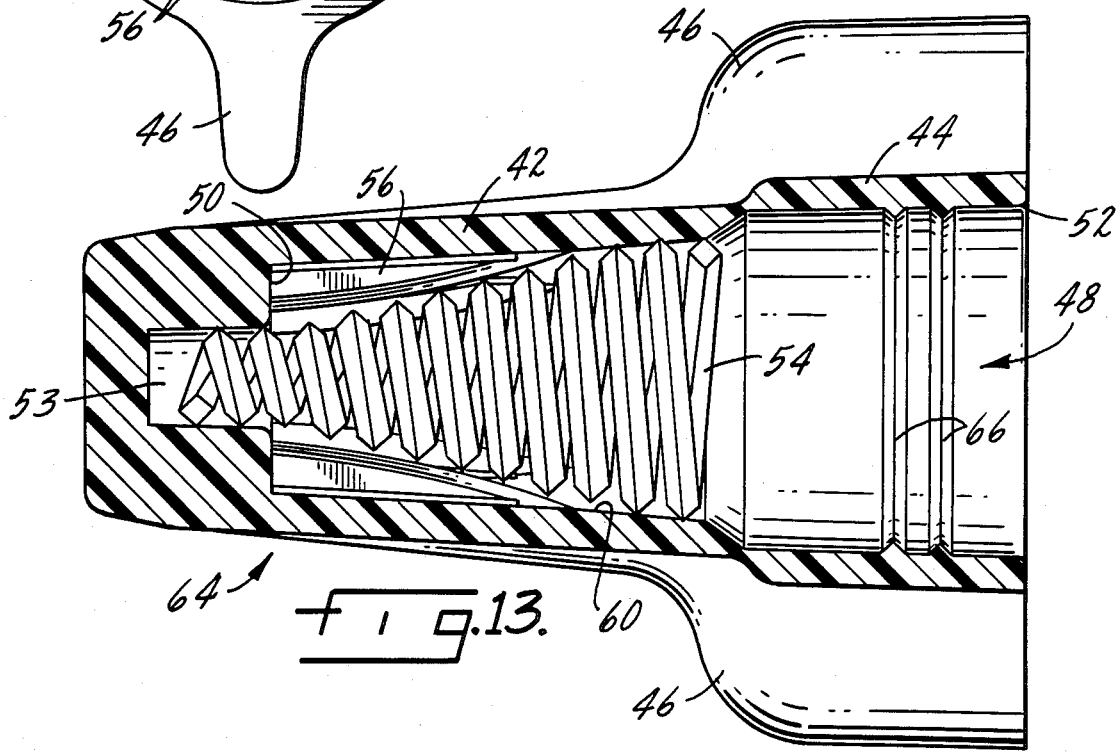
FIG. 13 is a longitudinal section of a further alternate embodiment.

FIG. 13 shows yet another alternate embodiment of a connector 64. This version is similar to that of FIGS. 11 and 12. Corresponding parts have been given the same reference numerals and their description will not be repeated. In this connector, the radial undercut has been removed from the junction between the housing and skirt. Instead, two radial undercuts 66 are located on the interior of the skirt. These undercuts serve to hold the cap or shell onto the core pin during molding so that the shell can be removed from the mold cavity. The undercuts also increase the dielectric strength of the connector in operation so that no electricity can arc out. The shape of the splines 56 in FIG. 13 is somewhat different from that in FIG. 11. The center of the splines' arc has been shifted so the splines protrude less into the bore and leave a greater outer area 60. The outside turns of the coil embed into the outer area. This may be accomplished in accordance with the method described and claimed in U.S. application Ser. No. 874,072, filed June 13, 1986 and assigned to the present assignee, the disclosure of which is hereby incorporated by reference.

Whereas various forms of the invention have been shown and described, it will be understood that modifications could be made thereto without departing from the scope of the following claims.

I claim:

1. In an electrical connector for joining the ends of electrical wires, a cap of insulating material having a central bore open at one end and enclosed at the other end by an integral end wall, a wire coil in the bore tapered such that its maximum diameter is at the end of the coil nearest the open end of the bore, with the coil engaging the cap only at that point, and a first radial undercut on the inside of the cap, closer to the end wall than to the open end and projecting into the bore, the wire coil diameter at the undercut being less than the inside diameter of the undercut such that the coil does not engage the undercut until electrical wires are inserted into the cap to expand the coil against the undercut.

2. The connector of claim 1 further comprising a plurality of axial splines on the inside of the cap, extending from the end wall toward the open end of the cap, past the undercut.

3. The connector of claim 1 further comprising a second radial undercut on the inside of the cap, closer to the open end of the bore than the first undercut.

4. In an electrical connector for joining the ends of electrical wires, a cap of insulating material having a central bore open at one end and enclosed at the other end by an integral end wall, a tapered wire coil in the bore, a radial undercut on the inside of the cap, closer to the end wall than to the open end and projecting into the bore and a plurality of axial splines on the inside of the cap, extending from the end wall toward the open end of the cap, past the undercut, the splines having an outer, conical portion generally conforming to the taper of the wire coil, and an inner straight portion leading to the end wall.

5. The connector of claim 4 wherein the undercut is located at the transition point from straight to conical splines.

6. In an electrical connector for joining the ends of electrical wires, a cap of insulating material having a central bore open at one end and enclosed at the other end by an integral end wall, a tapered wire coil in the bore, and a plurality of axial splines on the inside surface of the bore, extending from the end wall toward the open end of the cap but stopping short of the open end leaving an outer area of the bore with a smooth surface, the end of the wire coil being embedded into said outer area.

7. The connector of claim 6 further comprising a radial undercut on the inside of the cap, closer to the end wall than to the open end and projecting into the bore.

8. The connector of claim 6 wherein the cap includes a generally conical housing and a skirt of slightly larger diameter.

9. The connector of claim 8 wherein the end wall has a socket formed therein for receiving the wire coil.

10. The connector of claim 8 further comprising a radial undercut on the inside of the cap, at the junction between the housing and skirt, and projecting into the bore adjacent said outer area.

11. The connector of claim 8 further comprising at least one radial undercut on the inside of the skirt, projecting into the bore.

* * * * *